US011402790B2

(12) United States Patent
Higashida et al.

(10) Patent No.: US 11,402,790 B2
(45) Date of Patent: Aug. 2, 2022

(54) IMAGING SYSTEM

(71) Applicant: Hewlett-Packard Development Company, L.P., Spring, TX (US)

(72) Inventors: Katsushi Higashida, Yokohama (JP); Yasuyuki Ishii, Yokohama (JP); Hiroyuki Sato, Yokohama (JP); Koichiro Takashima, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/274,895

(22) PCT Filed: Apr. 16, 2019

(86) PCT No.: PCT/US2019/027657
§ 371 (c)(1),
(2) Date: Mar. 10, 2021

(87) PCT Pub. No.: WO2020/081115
PCT Pub. Date: Apr. 23, 2020

(65) Prior Publication Data

US 2022/0057741 A1 Feb. 24, 2022

(30) Foreign Application Priority Data

Oct. 16, 2018 (JP) ..... JP2018-195139

(51) Int. Cl.
*G03G 21/00* (2006.01)
*G03G 15/20* (2006.01)

(52) U.S. Cl.
CPC ..... *G03G 21/0094* (2013.01); *G03G 15/2025* (2013.01)

(58) Field of Classification Search
CPC ..... G03G 15/2025; G03G 21/0094
See application file for complete search history.

(56) References Cited

U.S. PATENT DOCUMENTS

| | | | | |
|---|---|---|---|---|
| 4,967,234 | A | 10/1990 | Tani et al. | |
| 7,359,657 | B2 | 4/2008 | Kikuchi et al. | |
| 7,616,922 | B2 | 11/2009 | Yoshino et al. | |
| 2011/0274474 | A1* | 11/2011 | Arai | G03G 21/0035 399/346 |

(Continued)

FOREIGN PATENT DOCUMENTS

| | | | |
|---|---|---|---|
| JP | 10-268658 | A | 10/1998 |
| JP | 2012-58430 | A | 3/2012 |
| JP | 2012-103297 | A | 5/2012 |

(Continued)

*Primary Examiner* — Jessica L Eley
(74) *Attorney, Agent, or Firm* — Jefferson IP Law, LLP

(57) ABSTRACT

An imaging system includes a main body to accommodate a roller, and a lubricant unit. The lubricant unit includes a casing having an opening and a lubricant storage disposed inside the casing to store a lubricant. The casing is pivotably connected to the main body to displace the casing between a closed position and an open position. In the closed position, the lubricant storage is positioned to bring the lubricant in contact with the roller through the opening, and the pivotable connection is disposed below the casing. In the open position, the opening is exposed to an outside of the main body, and the opening of the casing is disposed upward.

15 Claims, 12 Drawing Sheets

(56) References Cited

U.S. PATENT DOCUMENTS

| | | | | |
|---|---|---|---|---|
| 2013/0343782 | A1* | 12/2013 | Liu | G03G 21/0094 399/346 |
| 2014/0037304 | A1* | 2/2014 | Uenishi | F16N 29/02 399/346 |

FOREIGN PATENT DOCUMENTS

| | | | |
|---|---|---|---|
| JP | 2012-155094 | A | 8/2012 |
| JP | 5386922 | B2 | 1/2014 |
| JP | 5640676 | B2 | 12/2014 |

* cited by examiner

IMAGING SYSTEM

BACKGROUND

In some imaging apparatuses including an image carrier and a lubricant application device which applies a lubricant to the image carrier, the lubricant application device includes a lubricant coating roller which applies a lubricant to the image carrier and a pressing unit that presses and urges a lubricant to the lubricant coating roller. The pressing unit may include a lubricant casing which stores a lubricant and a pressing spring which is accommodated in the lubricant casing and presses the lubricant toward the image carrier.

BRIEF DESCRIPTION OF DRAWINGS

FIG. 10A is a perspective view of an example lubricant having a drawing member at an end portion in a longitudinal direction.

FIG. 10B is a perspective view of an example lubricant having a drawing member at an end portion in a width direction.

FIG. 11A is a cross-sectional view of an example lubricant unit with a lubricant, in which a bent pressing member is inserted through a penetration hole.

FIG. 11B is a cross-sectional view of an example lubricant unit with a lubricant, in which a linearly disposed pressing member is inserted through a penetration hole.

FIG. 12 is a cross-sectional view of an example lubricant unit with a lubricant roller, illustrating the lubricant unit disposed in the open position.

DETAILED DESCRIPTION

In the following description, with reference to the drawings, the same reference numbers are assigned to the same components or to similar components having the same function, and overlapping description is omitted. In some examples, an imaging system may include an imaging apparatus such as a printer or the like. In some examples, the imaging system may include a lubricant application device used in an imaging apparatus or the like, or a lubricant application device provided separately from an imaging apparatus or the like.

Figure 1:
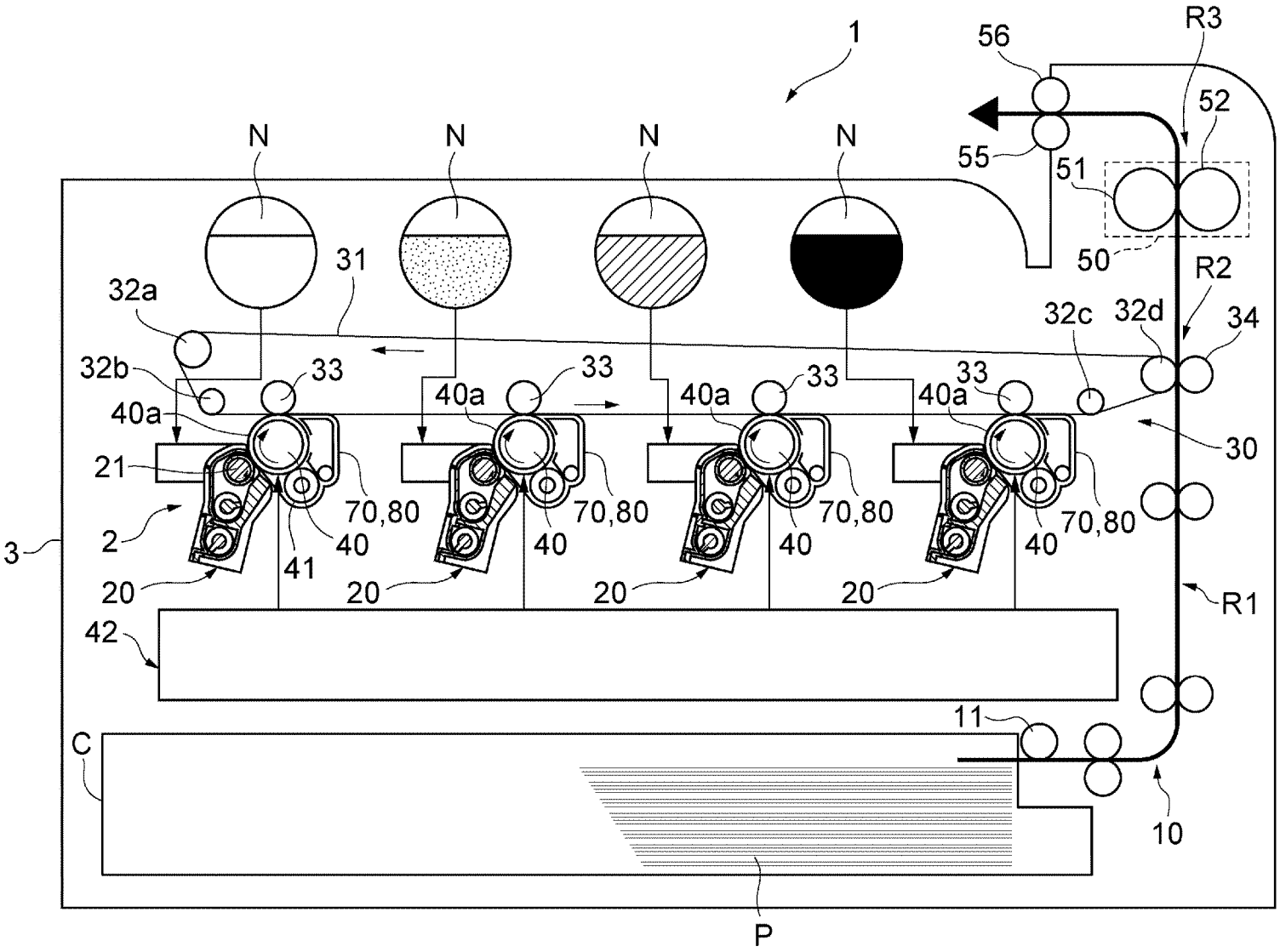
FIG. 1 is a schematic diagram of an example imaging apparatus.

FIG. 1 is a diagram illustrating a schematic configuration of an example imaging apparatus. With reference to FIG. 1, an imaging apparatus 1 may be an apparatus which forms a color image by using magenta, yellow, cyan, and black. The imaging apparatus 1 may include a conveying device 10 which conveys a sheet P corresponding to a recording medium, a developing device 20 which develops an electrostatic latent image, a transfer device 30 which secondarily transfers a toner image to the sheet P, an image carrier 40 in which an electrostatic latent image is formed on a surface (a peripheral surface), and a fixing device 50 which fixes a toner image to the sheet P.

The conveying device 10 may convey the sheet P which may correspond to a recording medium having an image formed thereon, along a conveying route R1. The sheet P may be stacked and accommodated on a cassette C and may be picked up and conveyed by a feeding roller 11. The conveying device 10 may allow the sheet P to reach a transfer nip portion R2 at a timing in which the toner image transferred to the sheet P reaches the transfer nip portion R2.

One developing device 20 may be provided for each of the four colors. Each developing device 20 may include a developing agent carrier 21 which carries toner on the image carrier 40. In the developing device 20 a two-component developing agent including toner and carrier may be used as a developing agent. The toner and the carrier may be adjusted to a selected or suitable mixing ratio and the toner and the carrier may be mixed and stirred to uniformly disperse the toner. Accordingly, the developing agent may be adjusted to obtain an optimal or suitable charge amount. The developing agent is carried by the developing agent carrier 21. The developing agent carrier 21 rotates to convey the developing agent to a region facing the image carrier 40. The toner in the developing agent carried on the developing agent carrier 21 may be transferred to the electrostatic latent image formed on an outer peripheral surface 40*a* of the image carrier 40 so that the electrostatic latent image is developed.

The transfer device 30 may convey a toner image formed by the developing device 20 to the transfer nip portion R2. The transfer device 30 may secondarily transfer the toner image to the sheet P via the transfer nip portion R2. The transfer device 30 may include a transfer belt 31 to which the toner image is primarily transferred from the image carrier 40, suspension rollers 32*a*, 32*b*, 32*c*, and 32*d* on which the transfer belt 31 is suspended, a primary transfer roller 33 which sandwiches the transfer belt 31 along with the image carrier 40, and a secondary transfer roller 34 which sandwiches the transfer belt 31 along with the suspension roller 32*d*.

The transfer belt 31 may be an endless belt which moves in a circulating manner by way of the suspension rollers 32*a*, 32*b*, 32*c*, and 32*d*. Each of the suspension rollers 32*a*, 32*b*, 32*c*, and 32*d* is a roller which is rotatable about each axis. The suspension roller 32*d* may be a drive roller which rotates about the axis. Each of the suspension rollers 32*a*, 32*b*, and 32*c* may be a driven roller which is rotated by the rotational driving of the suspension roller 32*d*. The primary transfer roller 33 may press against the image carrier 40 from the inner peripheral side of the transfer belt 31. The secondary transfer roller 34 may be disposed substantially in parallel to the suspension roller 32*d* with the transfer belt 31 interposed therebetween and may press against the suspension roller 32*d* from the outer peripheral side of the transfer belt 31. Accordingly, the secondary transfer roller 34 may form the transfer nip portion R2 between the secondary transfer roller and the transfer belt 31. For example, the transfer nip portion R2 is formed between the secondary transfer roller 34 and the transfer belt 31.

The image carrier 40 may also be referred to as an electrostatic latent image carrier, a photosensitive drum, or the like. One image carrier 40 may be provided for each of the four colors. Each image carrier 40 may be provided along the movement direction of the transfer belt 31. For example, the image carriers 40 may be spaced apart along the movement direction of the transfer belt 31. A number of components and devices may be mounted adjacent each of the image carriers 40. For example, the developing device 20, a charging roller 41, an exposure unit 42, a cleaning device 70, and a lubricant application device 80 may be provided at a position facing the outer peripheral surface 40*a* of the image carrier 40.

The example imaging apparatus 1 may include a process cartridge 2 and an apparatus body 3. The process cartridge 2 may integrally include the developing device 20, the image carrier 40, the charging roller 41, the cleaning device 70, and the lubricant application device 80. The apparatus body 3 may include a casing which accommodates the process cartridge 2. The process cartridge 2 may be attachable to or detachable from the apparatus body 3 in such a manner that a door of the apparatus body 3 is opened and the process cartridge is inserted into or removed from the apparatus body 3.

The charging roller 41 may include a charging member that uniformly charges a surface of the image carrier 40 to a predetermined potential. The charging roller 41 may be driven to follow the rotation of the image carrier 40. The exposure unit 42 may expose a surface (outer peripheral surface 40*a*) of the image carrier 40 charged by the charging roller 41 in response to an image formed on the sheet P. Accordingly, a potential of a portion exposed by the exposure unit 42 in the surface of the image carrier 40 may be changed so that an electrostatic latent image is formed. For example, four developing devices 20 may form the toner images by developing the electrostatic latent image formed on the image carriers 40 using the toner supplied from each of the toner tanks N respectively facing the developing devices 20. The toner tanks N may be filled with, for example, magenta toner, yellow toner, cyan toner, and black toner, respectively.

The fixing device 50 may allow the sheet P to pass through a fixing nip portion R3 for heating and pressing the sheet so that the toner image secondarily transferred from the transfer belt 31 to the sheet P is adhered and fixed to the sheet P. The fixing device 50 may include a heating roller 51 which heats the sheet P and a pressing roller 52 which presses and rotates the heating roller 51. Each of the heating roller 51 and the pressing roller 52 may have a cylindrical shape, and the heating roller 51 may include a heat source such as a halogen lamp provided therein. The fixing nip portion R3 may be a contact region provided between the heating roller 51 and the pressing roller 52. The fixing device 50 allows the sheet P to pass through the fixing nip portion R3 so that the toner image may be heat-fused and fixed to the sheet P. The example imaging apparatus 1 may be provided with discharge rollers 55 and 56 which discharge the sheet P having the toner image fixed thereto by the fixing device 50, to the outside of the imaging apparatus 1.

An example printing process which may be carried out by the example imaging apparatus 1 will be described. When an image signal of a recording target image is input to the imaging apparatus 1, a control unit of the imaging apparatus 1 outputs a control to rotate the feeding roller 11 so that the sheet P stacked on the cassette C is picked up and conveyed. The outer peripheral surface 40*a* of the image carrier 40 is uniformly charged to a predetermined potential by the charging roller 41 (a charging operation). A laser beam may be irradiated to the outer peripheral surface 40*a* of the image carrier 40 by the exposure unit 42 on the basis of the received image signal to form an electrostatic latent image (an exposing operation).

In the developing device 20, the electrostatic latent image is developed and a toner image is formed (a developing operation). The toner image which is formed in this way may be primarily transferred from the image carrier 40 to the transfer belt 31 in a region in which the image carrier 40 and the transfer belt 31 face each other (a transferring operation). The toner images formed on four image carriers 40 may be sequentially layered on the transfer belt 31 so that a single composite toner image is formed. The composite toner image may be secondarily transferred to the sheet P conveyed from the conveying device 10 in the transfer nip portion R2 in which the suspension roller 32*d* faces the secondary transfer roller 34.

The sheet P to which the composite toner image is secondarily transferred may be conveyed to the fixing device 50. The fixing device 50 may heat-fuse and fix the composite toner image to the sheet P by heating and pressing the sheet P between the heating roller 51 and the pressing roller 54 when the sheet P passes through the fixing nip portion R3 (a fixing operation). The sheet P may be discharged to the outside of the imaging apparatus 1 by the discharging rollers 55 and 56.

Figure 2:
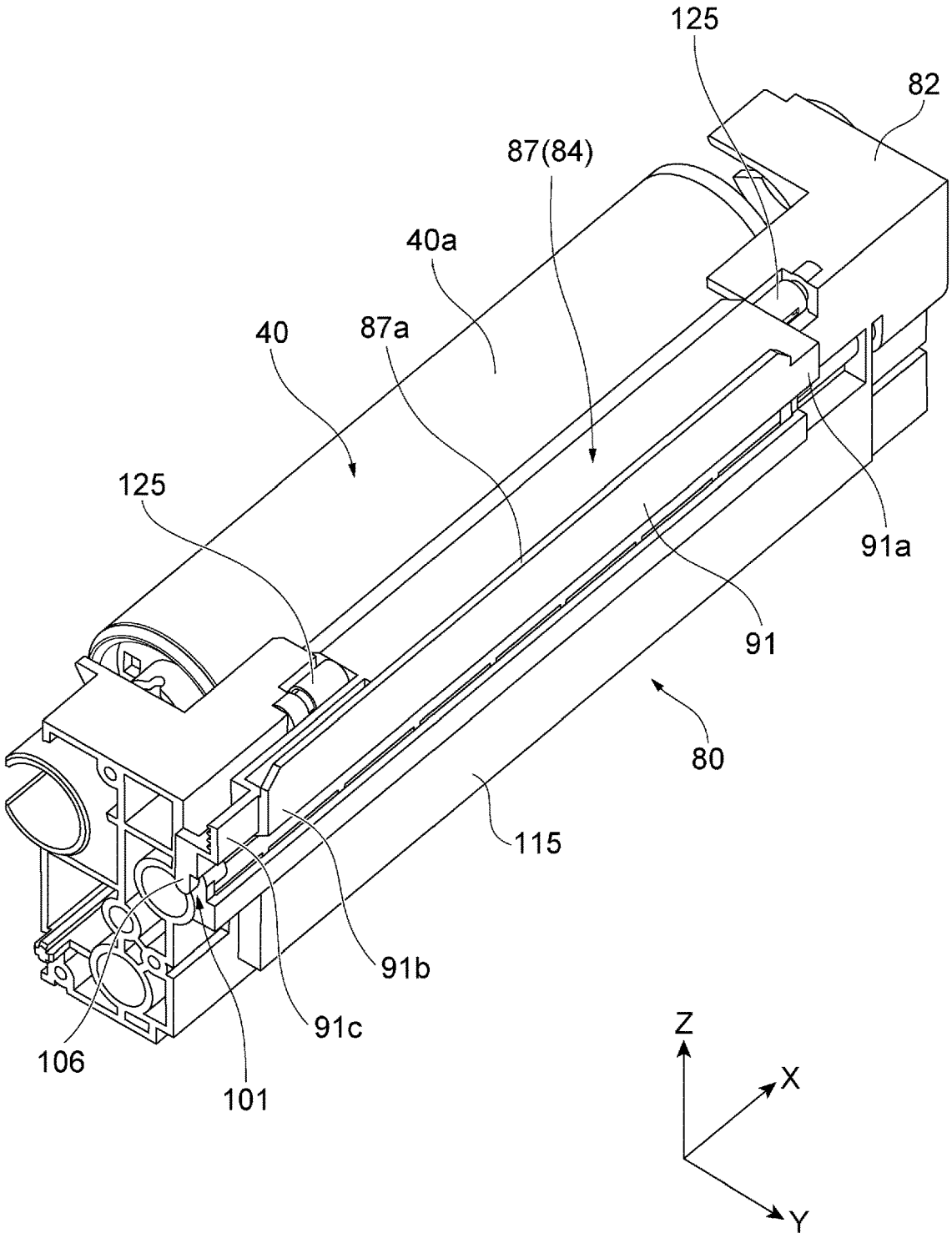
FIG. 2 is a perspective view of an image carrier and a lubricant application device in an example imaging apparatus, illustrating a case in which the lubricant application device has a lubricant unit in a closed position.
Figure 3:
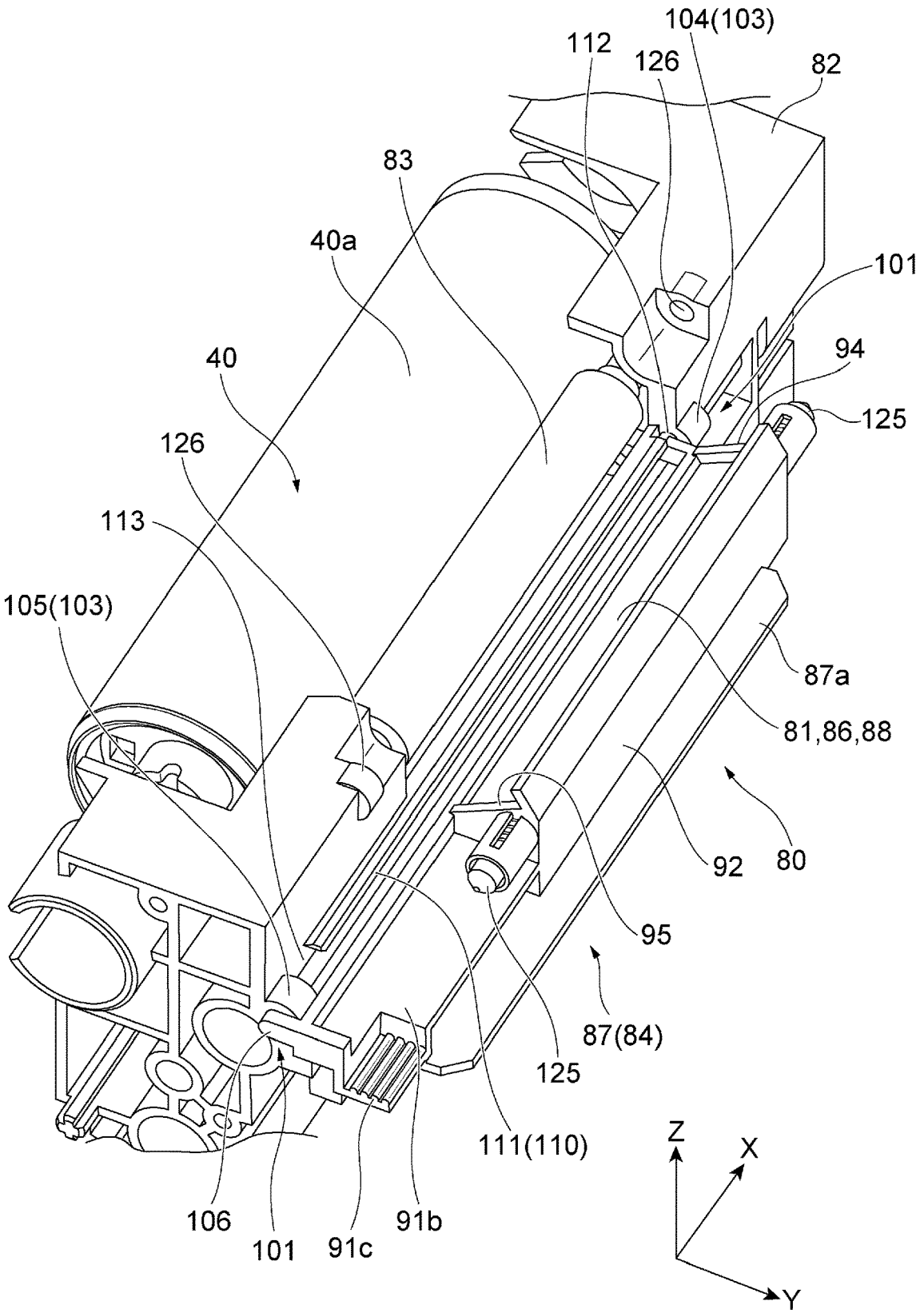
FIG. 3 is a perspective view illustrating the image carrier and the lubricant application device, illustrating a case in which the lubricant unit is in an open position.
Figure 4:
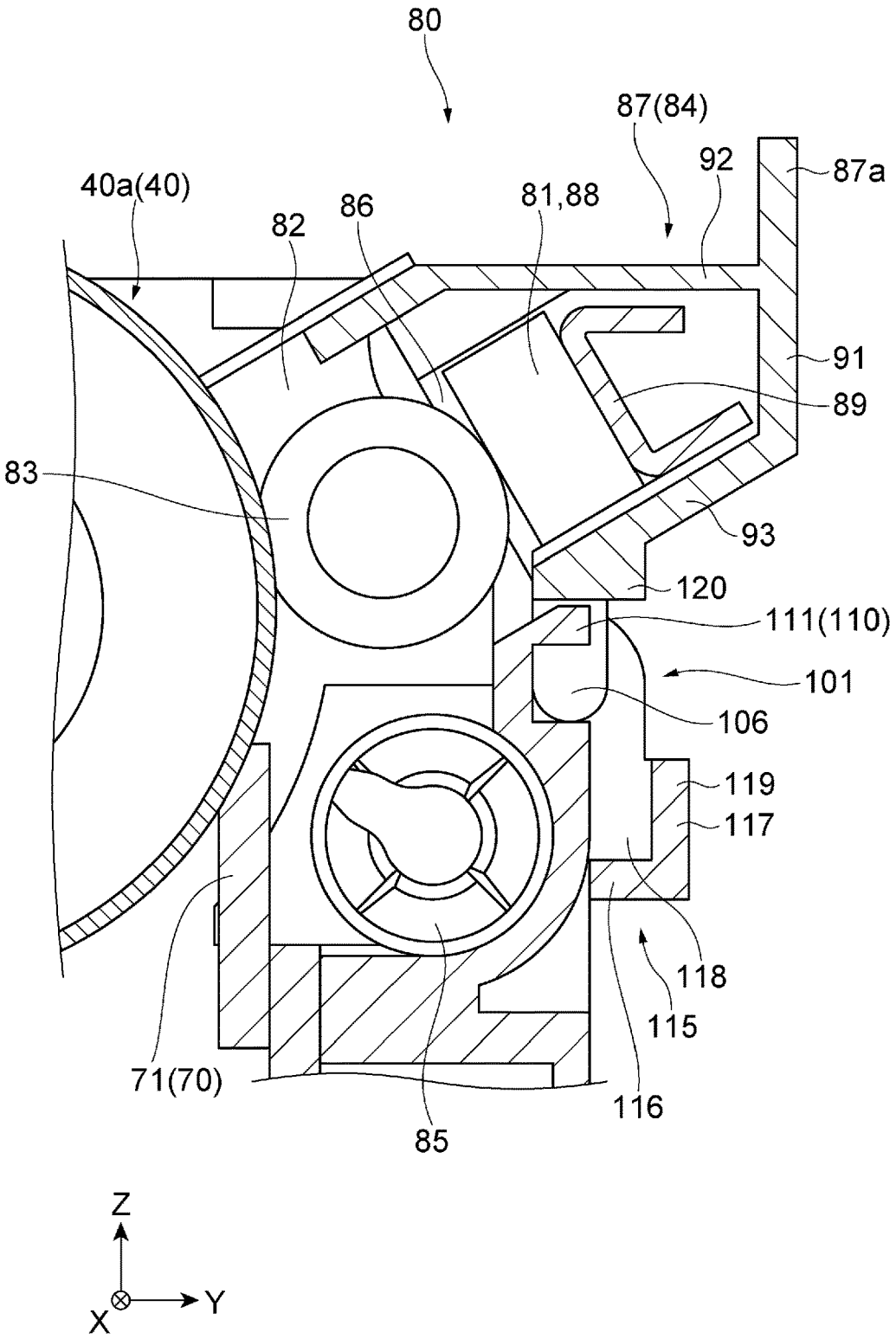
FIG. 4 is a cross-sectional view of the example lubricant application device illustrating a case in which the lubricant unit is in the closed position.

The example imaging apparatus 1 includes the cleaning device 70 and the lubricant application device 80. The cleaning device 70 may collect the toner remaining on the image carrier 40 after the toner image formed on the image carrier 40 is primarily transferred to the transfer belt 31. With reference to FIGS. 2 to 4, the lubricant application device 80 may apply a lubricant 81 to the outer peripheral surface 40*a* of the image carrier 40.

Figure 5:
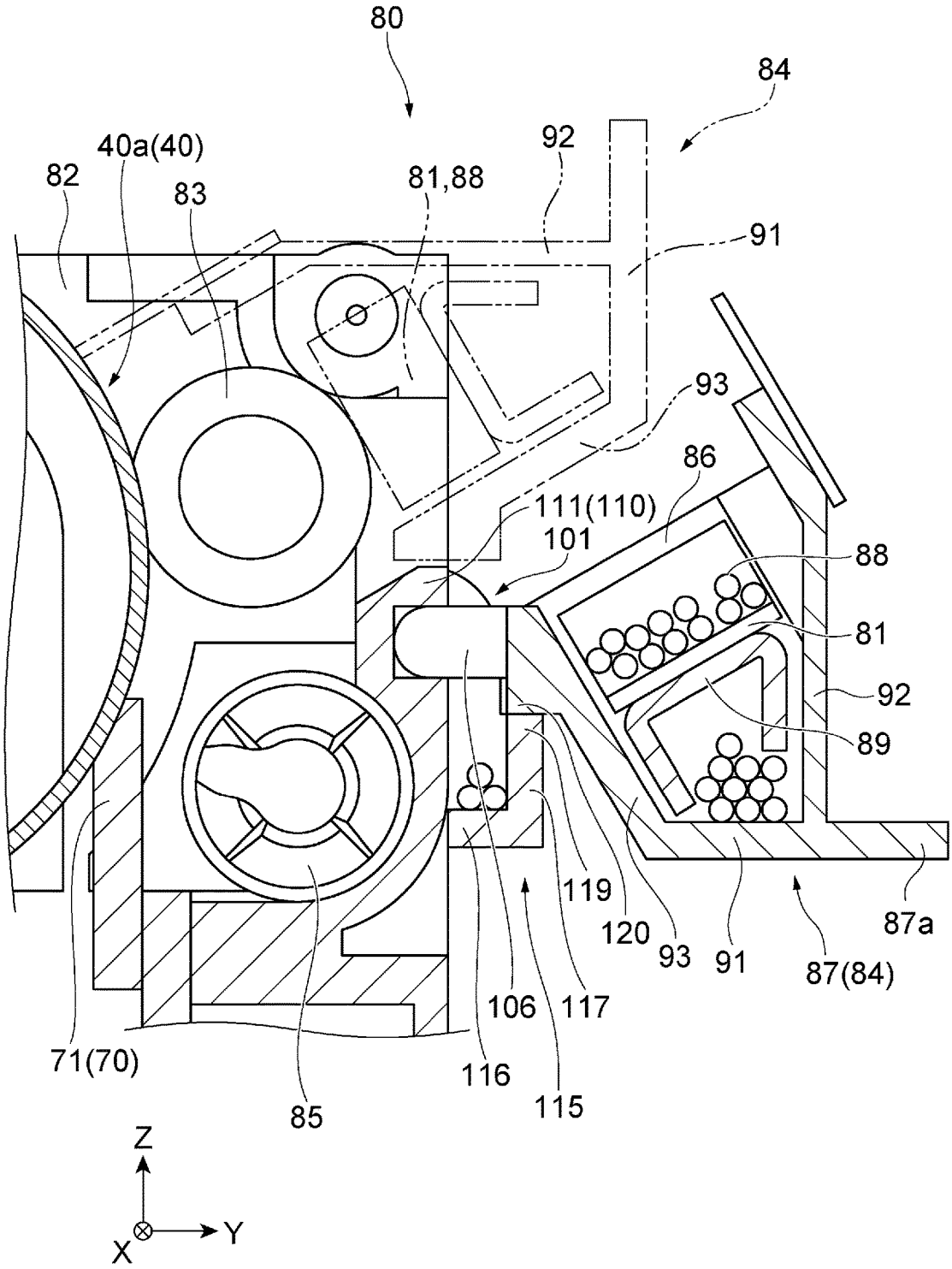
FIG. 5 is a cross-sectional view of the example lubricant application device, illustrating a case in which the lubricant unit is located in the open position.

With reference to FIGS. 4 and 5, the cleaning device 70 may include a cleaning blade 71 disposed at a position contacting the outer peripheral surface 40*a* of the image carrier 40. The cleaning blade 71 may contact the outer peripheral surface 40*a* of the image carrier 40 to scrape off the toner remaining on the outer peripheral surface 40*a*. The cleaning blade 71 may level the surface of the lubricant adhering to the outer peripheral surface 40*a*. In some examples, the cleaning device 70 may include an eraser (not illustrated) provided at the upstream side of the cleaning blade 71 in the rotation direction of the image carrier 40. The eraser may irradiate a beam to the electrostatic latent image formed on the outer peripheral surface 40*a* of the image carrier 40, to neutralize the image carrier 40 and erase image information of the image carrier 40.

In FIGS. 2 to 9, an X direction, a Y direction, and a Z direction which are three orthogonal directions are indicated by arrows. The X direction indicates an extension direction of the rotation axis of the image carrier 40 and indicates a longitudinal direction of the image carrier 40. The Z direction indicates the up and down direction. The Y direction indicates the direction orthogonal to the X direction and the Z direction.

With reference to FIGS. 2 and 3, the lubricant application device 80 may include a main body 82, a lubricant roller 83, and a lubricant unit 84. The main body 82 may accommodate the lubricant roller 83, as illustrated in FIG. 3. The main body 82 may include frames disposed at both sides of the lubricant roller 83 in the longitudinal direction. The main body 82 may rotatably holds the lubricant roller 83. The main body 82 may rotatably hold the image carrier 40. The rotation axis of the lubricant roller 83 extends in the X direction. As illustrated in FIGS. 2 to 4, the lubricant roller 83 may be adjacent to the image carrier 40 in the radial direction of the lubricant roller 83.

The lubricant roller 83 may be disposed at a position in which the lubricant roller can contact the outer peripheral surface 40*a* of the image carrier 40. The lubricant roller 83 may include a coating roller which applies a lubricant to the outer peripheral surface 40*a* of the image carrier 40. The lubricant roller 83 may be a bristle brush, for example. A rotation shaft of the lubricant roller 83 may be held by a bearing provided in the main body 82. The lubricant roller 83 may be driven to rotate by power transmitted from a motor driving the image carrier 40. A power transmission mechanism which transmits power to the lubricant roller 83 may include, for example, a gear, a belt, and the like.

The lubricant application device 80 may include, as illustrated in FIGS. 4 and 5, a waste toner collection screw 85. The waste toner collection screw 85 may be disposed below the lubricant roller 83. The waste toner collection screw 85 may be rotatable about the axis extending in the X direction. The waste toner collection screw 85 may be accommodated in the main body 82. The residual toner (e.g. waste toner) and residual lubricant (e.g. lubricant coming off or removed from the outer peripheral surface 40*a* of the image carrier 40) may be present inside the main body 82. The waste toner collection screw 85 can convey the waste toner and the residual lubricant inside the main body 82 in the X direction. One end portion of the main body 82 in the X direction may be provided with a waste toner collection box. The waste toner and the residual lubricant conveyed by the waste toner collection screw 85 may be collected to the waste toner collection box.

The lubricant unit 84 may include a casing 87 having an opening portion 86. A lubricant storage portion 88 which stores the lubricant 81 may be provided inside the casing 87. The casing 87 may be pivotable with respect to the main body through a pivotable connection portion (or pivot connection), to be opened or closed. A position of the casing 87 in an open state is set to an open position and a position of the casing 87 in a closed state is set to a closed position. The casing 87 is displaceable between the open position and the closed position. In FIGS. 2 and 4 illustrate the example casing 87 disposed in the closed position. FIGS. 3 and 5 illustrate the casing 87 disposed in the open position.

The casing 87 may include a cover plate 91. In the closed state, the cover plate 91 may be disposed at an opposite side to the image carrier 40 with respect to the lubricant roller 83, as illustrated in FIG. 4. In the closed state, the casing 87 may be oriented such that the plate thickness direction of the cover plate 91 is the Y direction, and such that the longitudinal direction of the cover plate 91 is the X direction. The cover plate 91 is longer than the lubricant roller 83 in the X direction. With reference to FIG. 2, the cover plate 91 may include a first end portion 91*a* and a second end portion 91*b* which are longitudinal end portions. The first end portion 91*a* and the second end portion 91*b* may be disposed at the outside of the lubricant roller 83 in the X direction. The second end portion 21*b* may be disposed at the outside of the image carrier 40 in the X direction.

With reference to FIGS. 3 to 6, the lubricant storage portion 88 may have a box shape having the opening portion 86. The casing 87 may include, as illustrated in FIG. 4, a first plate 92 and a second plate 93. In the closed position, the first plate 92 may be disposed above the lubricant roller 83. The first plate 92 may protrude from the cover plate 91 toward the image carrier 40 in the Y direction. The plate thickness direction of the first plate 92 may extend in the Z direction. For example, the first plate 92 may be disposed to be substantially orthogonal to the cover plate 91 as viewed from the X direction.

In the closed position, the second plate 93 may be disposed at substantially the same position as that of the lubricant roller 83 in the Z direction. In the closed position, the second plate 93 may protrude obliquely downward from the lower end portion of the cover plate 91. The second plate 93 protrudes to approach the lubricant roller 83.

The casing 87 may include a pair of side plates 94 and 95. The side plates 94 and 95 may be spaced apart from each other in the X direction as illustrated in FIG. 3. The plate thickness direction of each of the side plates 94 and 95 may extend in the X direction. The lubricant storage portion 88 may include the cover plate 91, the first plate 92, the second plate 93, and the pair of side plates 94 and 95. The lubricant 81 may be stored in a space surrounded by the cover plate 91, the first plate 92, the second plate 93, and the pair of side plates 94 and 95.

The lubricant 81 may have a block shape. For example, the lubricant 81 may be formed in a prismatic shape. The lubricant 81 may be supplied to the outer peripheral surface 40*a* of the image carrier 40 to prevent the abrasion of the outer peripheral surface 40*a*, in order to improve the durability of the image carrier 40. In some examples, the lubricant 81 may include a metal soap. The lubricant 81 may be formed of a material containing zinc stearate in some examples.

With reference to FIGS. 4 and 5, the lubricant storage portion 88 may include a lubricant support member 89 that supports the lubricant 81. The lubricant support member 89 may be disposed at the opposite side to the lubricant roller 83 with respect to the lubricant 81. The lubricant storage portion 88 may include an urging member that urges the lubricant 81 toward the lubricant roller 83. The urging member may press the lubricant 81 against the lubricant roller 83 by urging the lubricant support member 89. The lubricant 81 and the lubricant support member 89 may move substantially obliquely downward along the second plate 93 to approach the lubricant roller 83 while the casing 87 is closed.

Figure 6:
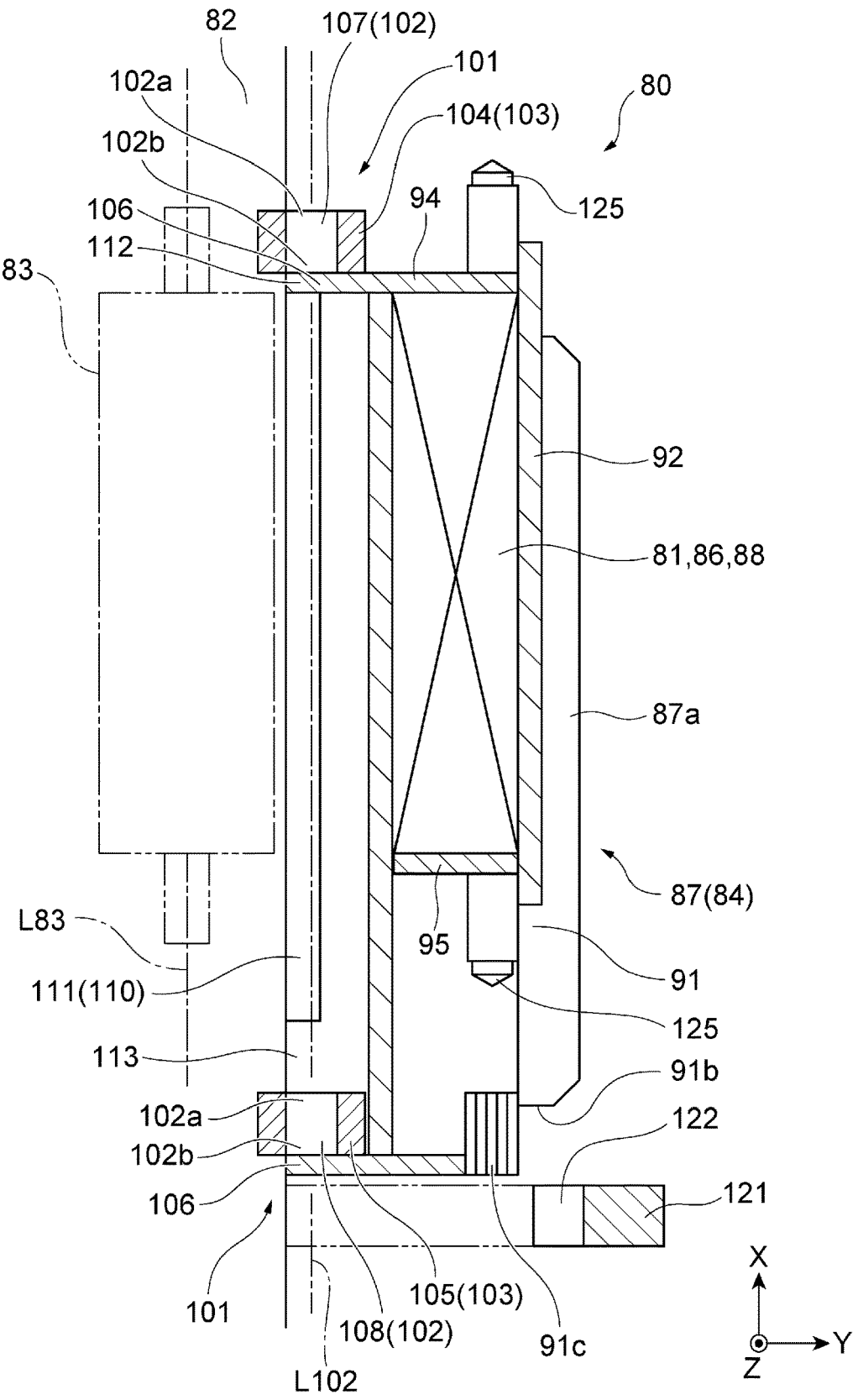
FIG. 6 is a plan view of the example lubricant application device, illustrating the lubricant unit in the open position.

With reference to FIG. 6, the pivotable connection portion (or pivot connection) may include a hinge 101. The hinge 101 may include a pin 102 and a bearing 103 receiving the pin 102. The bearing 103 may include a cylindrical sleeve. The bearing 103 rotatably supports the pin 102. The pin 102 may be detachable from the bearing 103. The lubricant unit 84 may be connected to the main body 82 in an attachable/detachable manner. The hinge 101 defines a rotation center axis (or rotational axis) L102 of the casing 87 with respect to the main body 82. The pin 102 may be supported by the bearing 103 to be rotatable about the rotation center axis L102. The main body 82 may include a pair of bearings 103 spaced apart from each other in the X direction. The pair of bearings 103 is disposed along the X direction. In the pair of bearings 103, one bearing is set as a first bearing 104 and the other bearing is set as a second bearing 105.

The casing 87 may include a pair of pins 102, each pin 102 having a columnar shape. The pin 102 includes a first end portion 102*a* and a second end portion 102*b*. The first end portion 102*a* is a front end portion and the second end portion 102*b* is a base end portion. The pin 102 may be connected to the cover plate 91. The base end portion of the pin 102 may be connected to the cover plate 91 through a pin base 106. The pin base 106 protrudes in the radial direction of the pin 102. In the pair of pins 102, one pin 102 is set as a first pin 107 and the other pin is set as a second pin 108. The first pin 107 may be supported by the first bearing 104. The second pin 108 may be supported by the second bearing 105.

The first end portion 102*a* of the first pin 107 protrudes from the pin base 106 in a first direction. The first end portion 102*a* of the second pin 108 protrudes from the pin base 106 in the first direction. The first pin 107 and the second pin 108 protrude in the same direction. The pin base 106 connected to the first pin 107 is connected to the side plate 94 of the cover plate 91. The pin base 106 connected to the first pin 107 may be connected to the first end portion 91*a* of the cover plate 91. The pin base 106 connected to the second pin 108 may be connected to the second end portion 91*b* of the cover plate 91.

The pin 102 may be separated from the bearing 103 when moving in a second direction, where the second direction is opposite to the first direction. Accordingly, the lubricant unit 84 can be separated from the main body 82. The first direction and the second direction are set to follow the X direction.

The bearing 103 may be disposed, as illustrated in FIGS. 4 and 5, between the lubricant roller 83 and the waste toner collection screw 85 in the Z direction. The bearing 103 may be disposed below the rotation center of the lubricant roller 83 in the Z direction. For example, the rotation center axis L102 of the casing 87 may be disposed below a rotation center L83 of the lubricant roller 83. The bearing 103 is provided at the opposite side to the image carrier 40 with respect to the lubricant roller 83 in the Y direction.

With reference to FIGS. 3 to 9, the main body 82 may include a guide 110 to guide the movement of the pin 102 in the X direction. The guide 110 may extends in the X direction between the pair of bearings 103. The guide 110 may include a protrusion piece 111 which protrudes toward the opposite side to the image carrier 40 in the Y direction. The protrusion piece 111 defines the position of the pin 102 in the Z direction while contacting the pin 102 in the Z direction. The protrusion piece 111 is disposed at both sides of the pin 102 in the Z direction. The guide 110 may include a guide groove which is recessed inward from the outer surface of the main body 82. The guide 110 may include a step portion formed on the outer surface of the main body 82. In an example operation, the lubricant unit 84 may be moved in the second direction to be separated from the main body when separating the lubricant unit 84, with the second pin 108 being guided by the guide. In an example operation, the lubricant unit 84 may be moved in the first direction to be attached to the main body 82 when attaching the lubricant unit 84 to the main body 82, with the second pin 108 being guided by the guide 110. The main body 82 may include a guide which guides the movement of the first pin 107 in the first direction and the second direction.

With reference to FIG. 6, gaps 112 and 113 may be formed between the guide 110 and the pair of bearings 103 in the X direction. For example, the gap 112 between the guide 110 and the first bearing 104 supporting the first pin 107 is a space in which the pin base 106 connected to the first pin 107 can be disposed. The pin base 106 connected to the first pin 107 may be located in the gap 112 between the first bearing 104 and the guide 110. For example, in a state in which the lubricant unit 84 is in the closed position, the pin base 106 connected to the first pin 107 may be located in the gap 112 between the guide 110 and the first bearing 104.

In some examples, the gap 113 between the guide 110 and the second bearing 105 supporting the second pin 108 may be a space through which the first pin 107 can pass. The first pin 107 separated from the first bearing 104 may be displaced along the guide 110 to a position in which the first pin can contact the second bearing 105. Since the gap 113 is formed between the guide 110 and the second bearing 105 in the X direction, the first pin 107 is movable upward through the gap 113.

With reference to FIG. 4, the pivotable connection portion (or pivot connection) may be disposed below the casing 87 in a state in which the casing 87 is disposed in the closed position. The opening portion 86 is disposed in a relatively downward orientation when the casing 87 is in the closed position. The lubricant 81 stored in the lubricant storage portion 88 can contact the lubricant roller 83 through the opening portion 86. The lubricant stored in the lubricant storage portion may be disposed obliquely above the rotation center of the lubricant roller as viewed from the X direction.

With reference to FIGS. 4 and 5, the lubricant application device 80 may include a waste toner storage portion 115 disposed below the pivotable connection portion. The waste toner storage portion 115 may include a concave portion which is recessed downward. The waste toner storage portion 115 may be provided at the outer surface of the main body 82. The waste toner storage portion 115 may be continuous from the outside of the first bearing 104 to the outside of the second bearing 105 in the X direction. The waste toner storage portion 115 may include an outer wall of the main body 82, a bottom plate 116, a main plate 117, and a pair of end plates 118.

The main plate 117 may be disposed to face the outer wall of the main body 82 in the Y direction. The plate thickness direction of the main plate 117 may extend in the Y direction. A space may be formed between the main plate 117 and the outer wall of the main body 82. The main plate 117 may be disposed at the outside of the bearing 103 in the Y direction. The outside in the Y direction may indicate an opposite side to the image carrier 40 with respect to the lubricant roller 83. The bottom plate 116 may extend in the Y direction from the outer wall of the main body 82. The plate thickness direction of the bottom plate 116 may extend in the Z direction. The bottom plate 116 may be connected to the lower end portion of the main plate 117. The bottom plate 116 closes the gap between the outer wall of the main body 82 and the main plate 117 from below. The pair of end plates 118 may be disposed to be spaced apart in the X direction. The plate thickness direction of the end plate 118 may extend in the X direction. The end plate 118 may protrude in the Y direction from the outer wall of the main body 82. The end plate 118 may be connected to the end portion of the bottom plate 116 and the end portion of the end plate 118 in the X direction. The pair of end plates 118 may close the gap between the outer wall of the main body 82 and the main plate 117 from both sides in the X direction.

The lubricant application device 80 may include a stopper 119 which regulates the rotation angle (the pivot range) of the casing 87. The stopper 119 may be provided in the main body 82 and contact the casing 87 when the casing 87 is disposed in the open position. The stopper 119 may include the main plate 117 of the waste toner storage portion 115. The upper end portion of the main plate 117 may contact the casing 87 to define the open position of the casing 87. The casing 87 may include a contact portion 120 which can contact the stopper 119. The contact portion 120 may contact the stopper 119 in the closed position and move away from the stopper 119 (e.g. the contact portion 120 does not contact the stopper 119) in the open position. In the contact portion 120, the casing 87 located in the closed position is indicated by a two-dotted chain line in FIG. 5. The contact portion 120 may be provided at a connection portion between the pin base 106 and the second plate 93 in the radial direction of the pin 102. The contact portion 120 includes a surface which contacts the stopper 119. The stopper 119 and the contact portion 120 may be continuous in the direction of the rotation center axis L102 of the casing 87.

With reference to FIG. 6, the casing 87 may include a convex portion 87*a* which protrudes outward in the radial direction of the rotation center axis L102 (the pin 102) of the casing 87. The convex portion 87*a* may protrude from the cover plate 91. The convex portion 87*a* may protrude to the outside of the first plate 92 in the radial direction of the rotation center axis L102. The convex portion 87*a* may protrude in the Y direction in the open position of the casing 87. The convex portion 87*a* may be continuous in the X direction. The convex portion 87*a* may be shorter than the cover plate 91 in the X direction. The convex portion 87*a* may be formed in a plate shape. The plate thickness direction of the convex portion 87*a* may be the Z direction in the open position.

With reference to FIGS. 6 to 9, the lubricant application device 80 may include a main body side guide member 121. The main body side guide member 121 may be attached to the apparatus body 3. The main body side guide member 121 may be disposed at a position not overlapping the lubricant unit 84 as viewed from the Z direction while the lubricant unit 84 is attached to the main body 82 as illustrated in FIG. 6. The main body side guide member 121 may be disposed at the outside of the lubricant unit 84 in the X direction. The main body side guide member 121 may be disposed at the side of the second end portion 91*b* in the longitudinal direction of the cover plate 91.

The main body side guide member 121 may be provided with a concave portion or recessed portion (e.g. a first concave portion) 122 which is recessed in the Y direction toward the opposite side to the image carrier 40, relative to the lubricant unit 84. The concave portion 122 extends in the X direction. The concave portion 122 may be formed at the same position as the convex portion 87*a* of the lubricant unit 84 in the open position as viewed from the X direction. The convex portion 87*a* in the open position can pass through the concave portion 122 in the X direction.

The main body side guide member 121 may be provided with a concave portion (a second concave portion) 123 which is recessed upward in the Z direction and extends in the X direction. The concave portion 123 may be formed at a same position as the convex portion 87*a* of the lubricant unit 84 in the closed position as viewed from the X direction. The convex portion 87*a* in the closed position can pass through the concave portion 123 in the X direction.

The lubricant unit 84 may include, as illustrated in FIG. 3, a latch 125. The latch 125 is an engagement portion which can engage with the main body 82. The latch 125 may be provided in the side plates 94 and 95. The latch 125 protrudes outwardly in the X direction. The latch 125 may engage with an engagement hole (an engagement concave portion) 126 provided in the main body 82. When the lubricant unit 84 is in the closed position, the latch 125 engages with the engagement hole 126. The latch 125 may be provided at other positions of the casing 87. The latch 125 may protrude in a direction intersecting the X direction. The latch 125 may include a claw which can engage with the main body 82. The latch 125 may include an urging member such as a spring.

In the example imaging apparatus 1, the casing 87 of the lubricant unit 84 may be closed in a normal operational state. In this closed state, the lubricant roller 83 contacts the outer peripheral surface 40*a* of the image carrier 40 and contacts the lubricant 81, as illustrated in FIG. 4. The lubricant roller 83 may be driven to rotate by power transmitted from an electric motor. As viewed from the X direction, the rotation direction of the lubricant roller 83 may be opposite to the rotation direction of the image carrier 40. The lubricant roller 83 may scrape off the lubricant 81 in a rotation state and apply the lubricant 18 to the outer peripheral surface 40*a* of the image carrier 40. According to the example lubricant application device 80, since the lubricant 81 can be applied to the outer peripheral surface 40*a* of the image carrier 40, it is possible to prevent the abrasion of the image carrier 40 and to improve the intermediate transfer performance. In the example imaging apparatus 1, it is possible to improve the durability of the image carrier 40 and extend the replacement timing of the image carrier 40.

Since the casing 87 is pivotable with respect to the main body 82, the lubricant 81 can be disposed in a position spaced away from the lubricant roller 83 (e.g. not contacting the lubricant roller 83) in the open position of the casing 87. The user of the imaging apparatus 1 can replenish the lubricant 81, for example, when the amount of the lubricant 81 remaining in the lubricant storage portion 88 is small. In some examples, the user opens the casing 87 when replenishing the lubricant 81, by opening the door of the apparatus body 3 and operating a knob 91*c* of the cover plate 91.

As illustrated in FIG. 5, when the case 87 is operated in the open position, the opening portion 86 may be oriented upward. Accordingly, it is possible to prevent or reduce leakage of the lubricant 81 and of the waste toner inside the casing 87. A case in which the opening portion 86 is disposed upward may include a case in which the opening portion 86 is disposed obliquely upward. In the example lubricant application device 80, it is possible to prevent the opening portion 86 from being disposed downward in the open position so that the lubricant 81 and the waste toner inside the casing 87 are prevented from leak to the outside.

Figure 7:
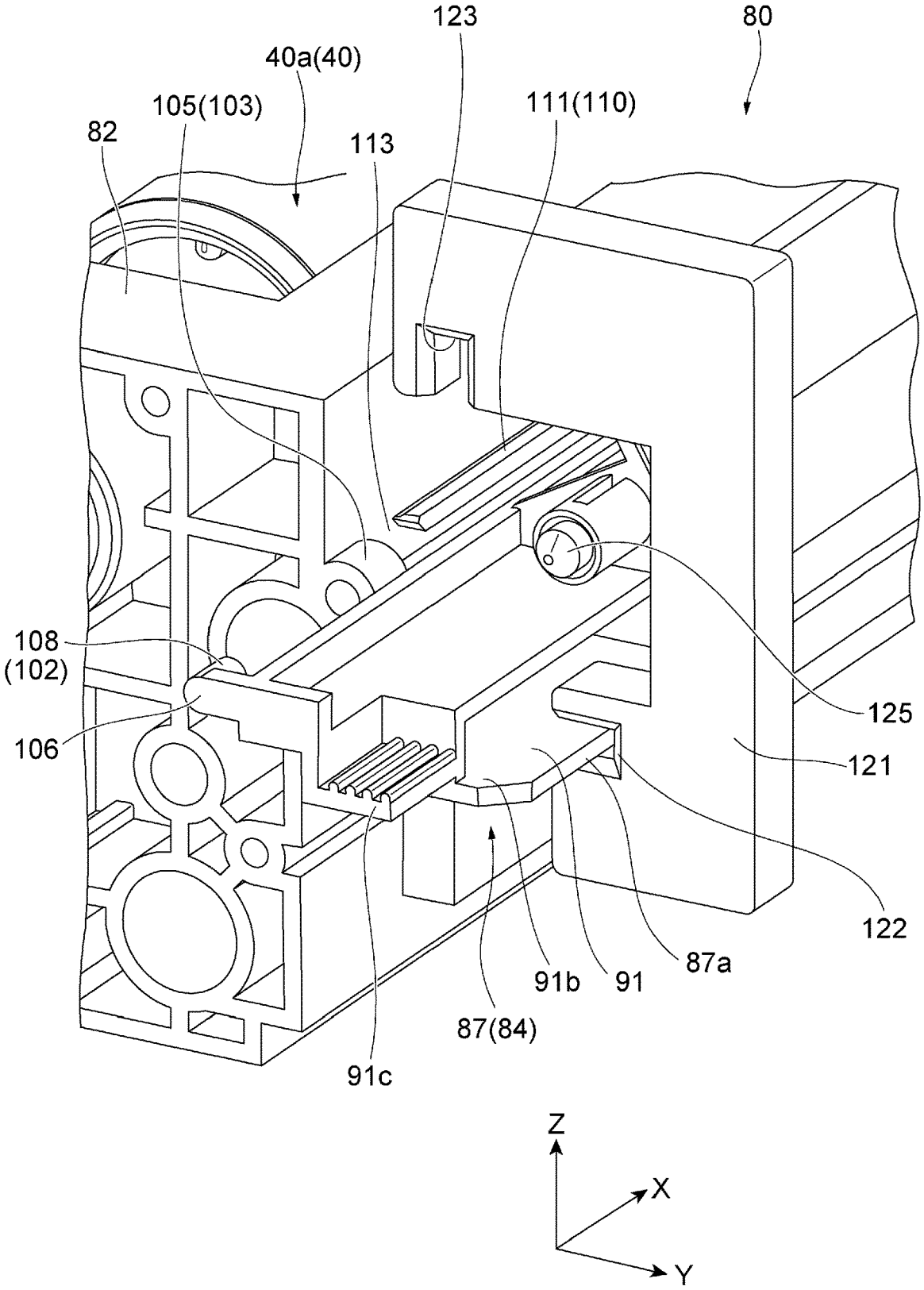
FIG. 7 is a partial perspective view of the example lubricant application device in an example operation in which the lubricant unit is separated, illustrating a state where a second pin is separated from a second bearing.
Figure 8:
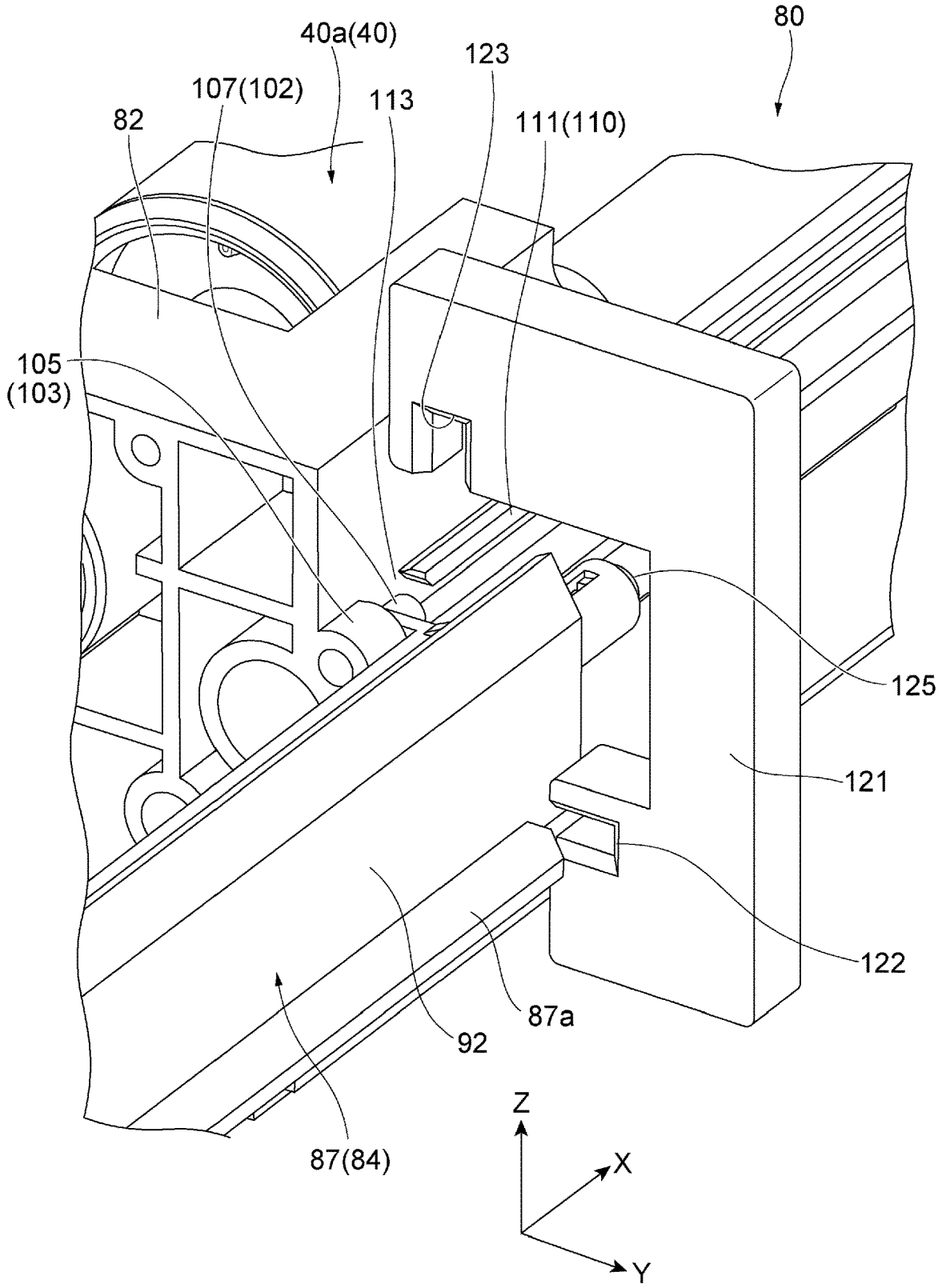
FIG. 8 is a partial perspective view of the example lubricant application device in an example operation in which the lubricant unit is separated, illustrating a state where a first pin moves to a position adjacent to the second bearing.

In the example imaging apparatus 1, it is possible to move the lubricant unit 84 in the X direction to be separated from the main body 82 while the opening portion 86 is disposed upward. When replenishing the lubricant 81, the user can extract the lubricant unit 84 in the X direction by pulling the knob 91*c* of the cover plate 91. As illustrated in FIGS. 7 and 8, the lubricant unit 84 may be displaced in the X direction so that the lubricant unit 84 can be separated from the main body 82. The user may replenish the lubricant unit 84 that is separated from the main body 82, with a new lubricant 81. The opening portion 86 is disposed upward when the lubricant unit 84 is moved in the X direction, to prevent the lubricant 81 and the waste toner inside the casing 87 from leaking to the outside. It is possible to prevent the contamination inside the apparatus body 3 when separating the lubricant unit 84.

In the example imaging apparatus 1, the lubricant unit 84 replenished with the lubricant 81 can be attached to the main body 82. The opening portion 86 is disposed upward when attaching the lubricant unit 84, in order to hold or support the lubricant 81 (e.g. the dropping of the lubricant 81 is prevented). In the example imaging apparatus 1, the lubricant unit 84 may be separated from the main body 82, in order to allow the lubricant 81 to be easily replenished. In the example imaging apparatus 1, the lubricant unit 84 may be separated while the image carrier 40 is attached to the main body 82, it is possible to prevent the image carrier 40 from being exposed to light. As a result, it is possible to prevent deterioration of the image carrier 40.

The first pin 107 is guided by the guide 110 when separating the lubricant unit 84 from the main body 82, to allow a smoother movement of the lubricant unit 84.

In the example imaging apparatus 1, the waste toner storage portion 115 is disposed below the hinge 101. Accordingly, the residual lubricant 81 and the waste toner collected inside the casing 87 are stored in the waste toner storage portion 115, to prevent or reduce leakage to the outside of the lubricant 81 and waste toner.

In the example imaging apparatus 1, the stopper 119 may limit the open position of the casing 87 (e.g. the open position of the casing 87 can be defined). Additionally, the stopper 119 is continuous in the X direction, and can be used as a guide when moving the lubricant unit 84, to move the lubricant unit 84 more smoothly.

Figure 9:
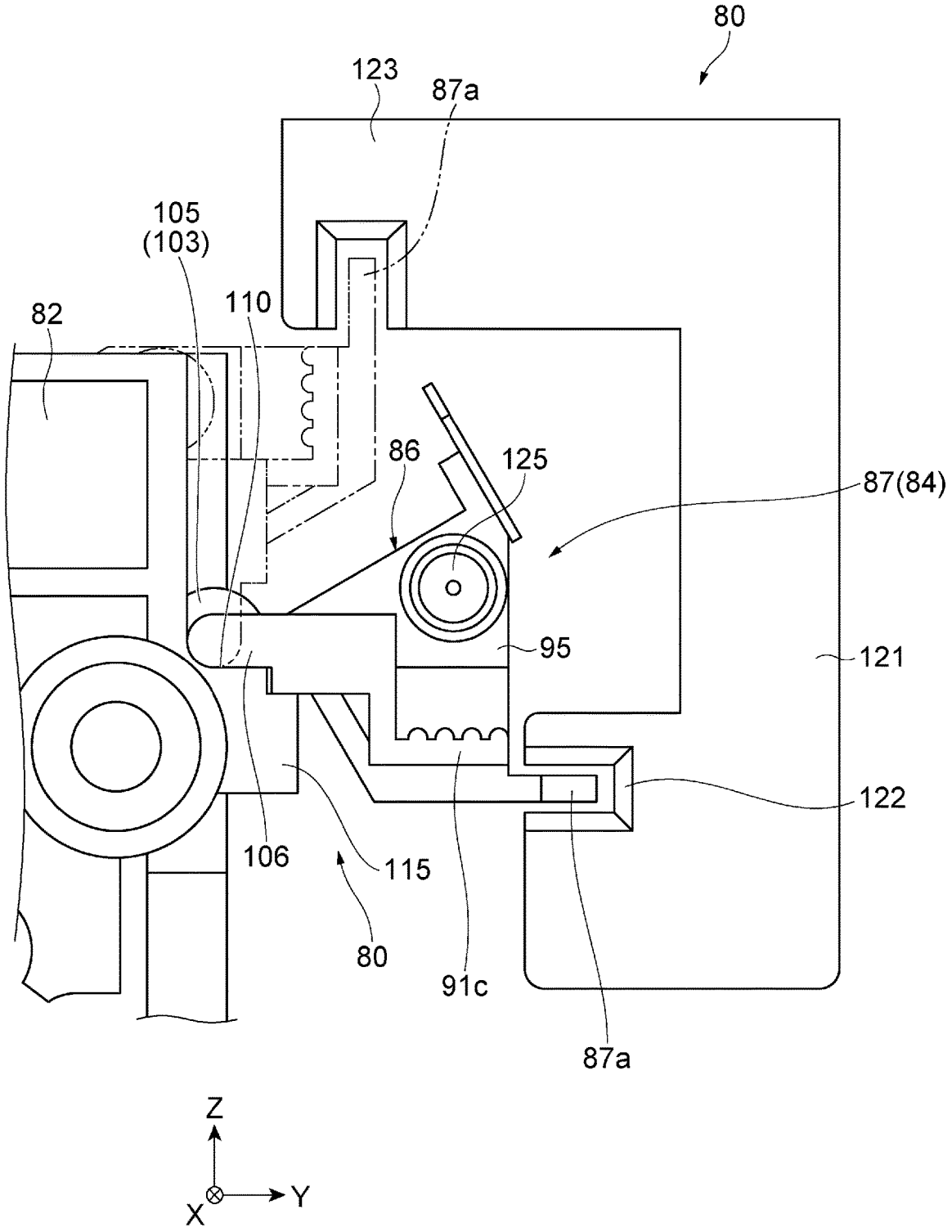
FIG. 9 is a side view of the example lubricant application device, illustrating a main body side guide member and the lubricant unit disposed in the open position.
Figure 1:
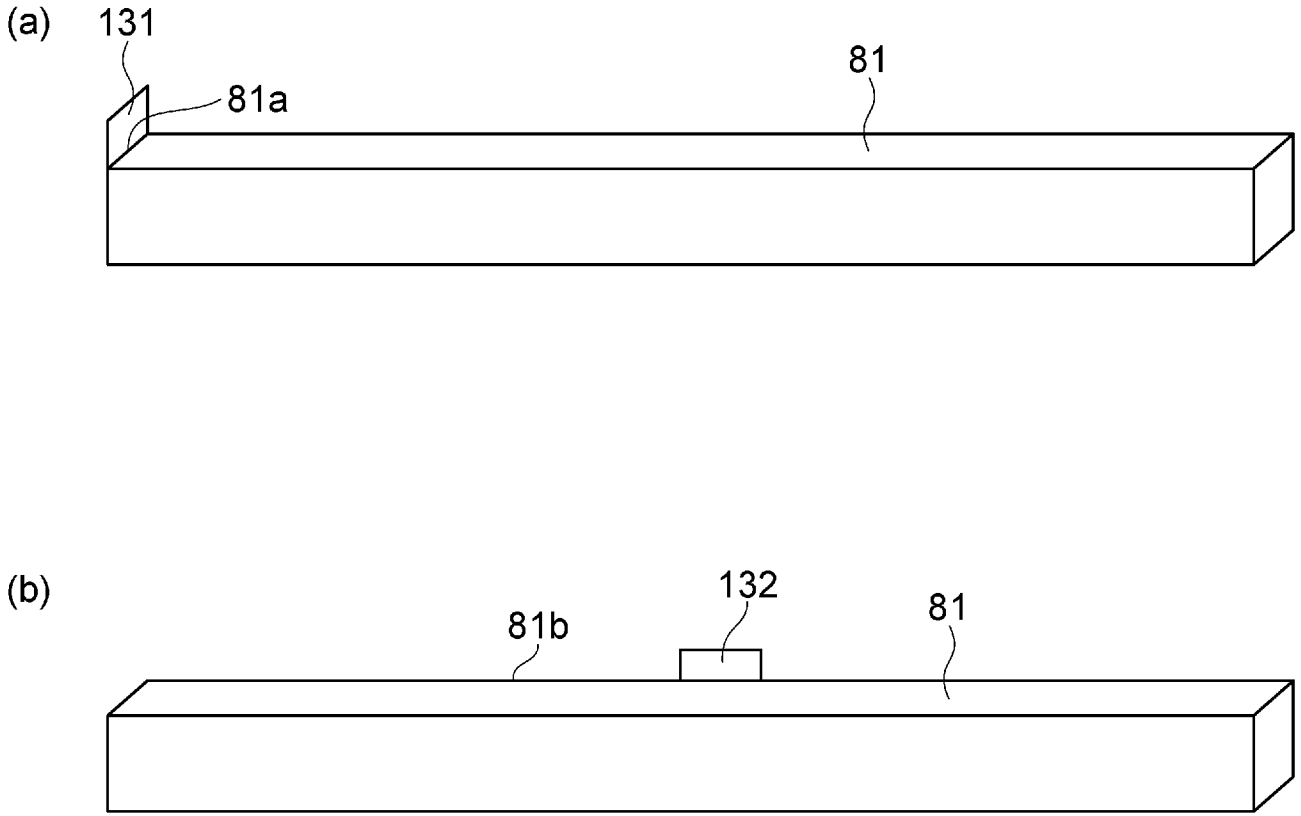
Figure 1:
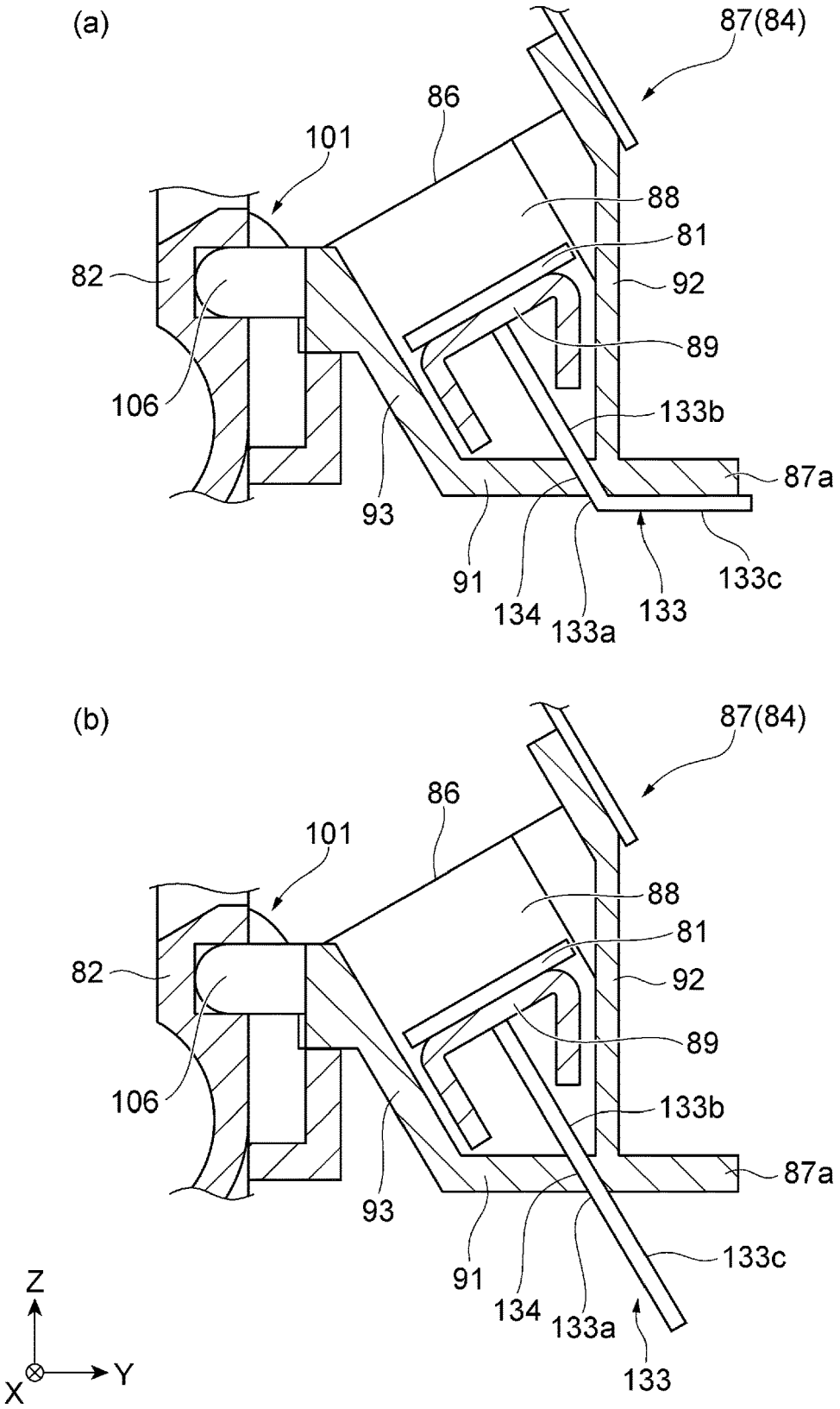
Figure 1:
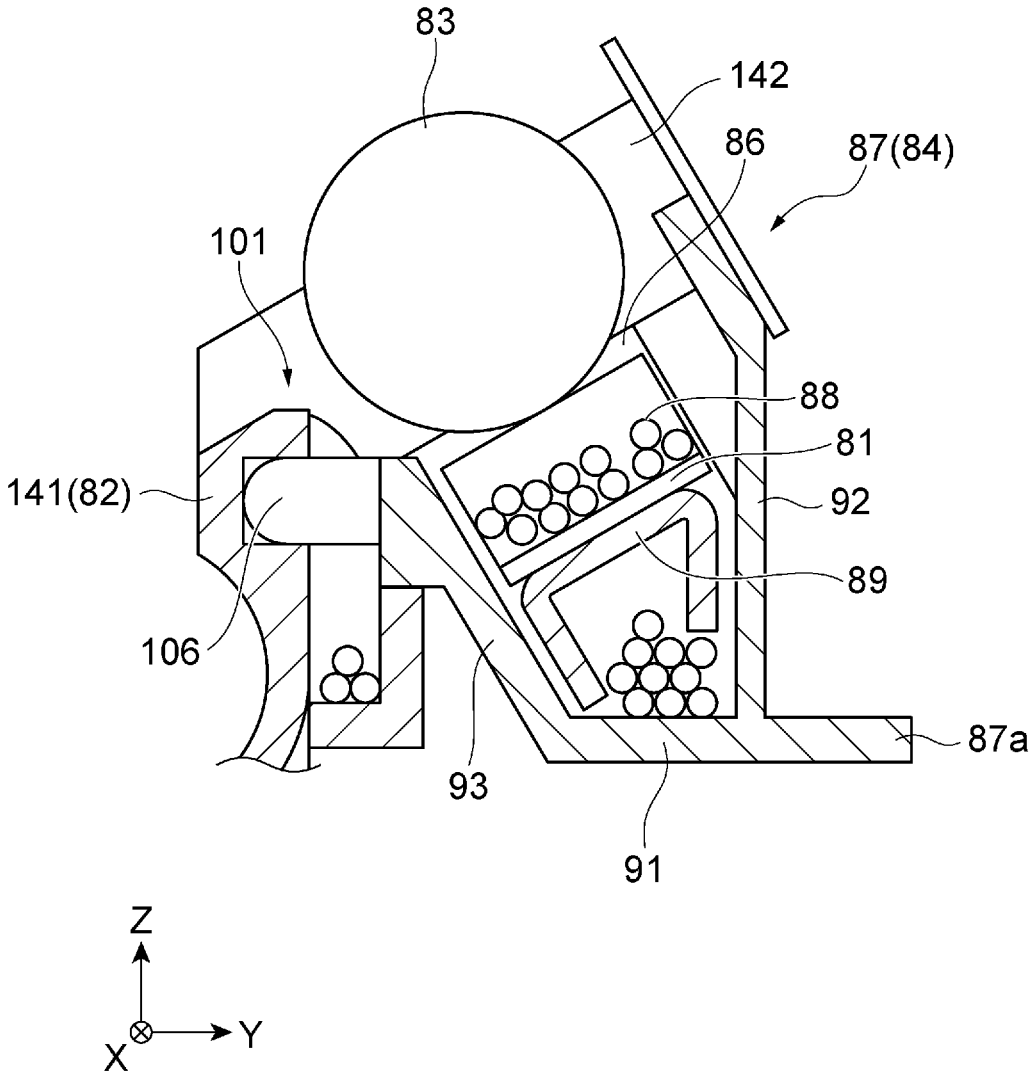

The example imaging apparatus 1 includes the main body side guide member 121 provided with the concave portion 122 as illustrated in FIG. 9. Accordingly, it is possible to position the lubricant unit 84 by using the position of the concave portion 122 as a mark when attaching the lubricant unit 84.

In the example imaging apparatus 1, the lubricant unit 84 can be separated from the apparatus body 3 along with the main body 82 while the casing 87 is operated in the closed position. For example, the process cartridge 2 integrally including the developing device 20, the image carrier 40, the charging roller 41, the cleaning device 70, and the lubricant application device 80 may be separated from the apparatus body 3. The example imaging apparatus 1 includes the main body side guide member 121 provided with the concave portion 123. Accordingly, it is possible to position the lubricant unit 84 by using the position of the concave portion 123 as a mark when attaching the process cartridge 2. The positioning of the lubricant unit 84 allows positioning the process cartridge 2 with respect to the apparatus body 3.

For example, when the process cartridge 2 is replaced, the lubricant unit 84 having a new lubricant 81 can be used. For example, the lubricant 81 may be replenished by opening or closing the casing 87 of the lubricant unit 84 in the process cartridge 2 of the apparatus body 3. For example, the lubricant roller 83 may be inspected, repaired, and replaced by opening or closing the casing 87 in the process cartridge 2.

As illustrated in FIGS. 10(*a*) and 10(*b*), the lubricant 81 may be provided with drawing members 131 and 132. The drawing members 131 and 132 may include flexible sheets (e.g. may be formed in a sheet shape with flexibility). The drawing members 131 and 132 may be formed of resin, cloth, or other materials. The drawing member 131 may be connected to an end portion 81*a* of the lubricant 81 in the longitudinal direction. In a state in which the lubricant 81 is stored in the lubricant storage portion 88, the drawing member 131 may be disposed to protrude toward the opening portion 86. For example, when the casing 87 is located in the open position, the drawing member 131 may protrude upward. The lubricant 81 can be taken out from the lubricant storage portion 88 by drawing the drawing member 131 when taking out the lubricant 81 stored in the lubricant storage portion 88. The drawing member 131 may be provided at both end portions of the lubricant 81 in the longitudinal direction.

The drawing member 132 may be connected to an end portion 81*b* of the lubricant 81 in the width direction. The width direction is set to a direction intersecting the longitudinal direction. In a state in which the lubricant 81 is stored in the lubricant storage portion 88, the drawing member 132 may be disposed to protrude toward the opening portion 86. For example, when the casing 87 is disposed in the open position, the drawing member 132 may protrude upward. The drawing member 132 may be provided at both end portions of the lubricant 81 in the width direction.

As illustrated in FIGS. 11(*a*) and 11(*b*), the lubricant unit 84 may be provided with a penetration hole 134 through which a pressing member 133 can be inserted. The pressing member 133 is used when pressing out the lubricant 81. The penetration hole 134 may be provided in the cover plate 91, for example. When the pressing member 133 having a bar shape is inserted through the penetration hole 134 and the lubricant 81 is pressed from the outside, the lubricant 81 can be moved toward the opening portion 86. For example, a front end of the pressing member 133 may be pressed against the lubricant support member 89. The pressing member 133 may be pressed against the lubricant 81.

As illustrated in FIG. 11(*a*), the pressing member 133 may include a bent portion 133*a*. The pressing member 133 may include a first portion 133*b* and a second portion 133*c* with the bent portion 133*a* interposed therebetween. The bent portion 133*a* may include a hinge portion. In a normal state (e.g. default operational arrangement), the bent portion 133*a* may be disposed at the outside of the casing 87. The first portion 133*b* may be disposed inside the casing 87 and the second portion 133*c* may be disposed outside the casing 87. The second portion 133*c* may extend in the Y direction along the cover plate 91 at the outside of the casing 87. In order to separate the lubricant 81 by using the pressing member 133, the first portion 133*b* and the second portion 133*c* may be disposed on the same line as illustrated in FIG. 11(*b*).

The main body 82 of the imaging apparatus 1 may include a first housing 141 which accommodates the image carrier 40 and a second housing 142 which accommodates the lubricant roller 83. The second housing 142 may be pivotably connected to the first housing 141 through the pivotable connection portion (e.g. the hinge 101) and is displaceable between the closed position and the open position. The second housing 142 which accommodates the lubricant roller 83 may be disposed in the open position while being pivoted along with the lubricant unit 84 as illustrated in FIG. 12. At the open position, the second housing 142 and the lubricant unit 84 may move in the X direction to be separated from the first housing 141 of the main body 82. For example, in the process cartridge 2, the lubricant roller 83 and the lubricant unit 84 may be integrally attachable or detachable.

The main body 82 may include another pivotable connection portion (or pivot connection) different from the hinge 101. The second housing 142 may be pivotably connected to the first housing 141 through another pivotable connection portion (or pivot connection). The second housing 142 may be opened or closed with respect to the first housing 141 through another pivotable connection portion (or pivot connection). A driving source for driving the lubricant roller 83 may be the same as or different from the driving source for driving the image carrier 40. A power transmission mechanism for transmitting driving power to the lubricant roller 83 may include a coupling member for example. The coupling member may connect a plurality of power transmission members in an attachable or detachable manner. The coupling member may separate or connect the power transmission members in response to the pivoting operation of the second housing supporting the lubricant roller 83.

It is to be understood that not all aspects, advantages and features described herein may necessarily be achieved by, or included in, any one particular example. Indeed, having described and illustrated various examples herein, it should be apparent that other examples may be modified in arrangement and detail.

One or more of the examples described above and/or features thereof may be expressed by the following clauses.

Clause 1. An imaging system including:

a main body which accommodates a roller; and a lubricant unit which includes a casing having an opening and a lubricant storage disposed inside the casing and storing the lubricant, in which the casing is pivotably connected to the main body through a pivotable connection and is displaceable between a closed position and an open position, in which in the closed position, the lubricant storage is disposed in a position in which the lubricant is able to be supplied to the roller through the opening in a contact state, in which in the open position, the lubricant storage is disposed so that the opening is exposed to an outside of the main body, in which the pivotable connection is disposed below the casing while the casing is disposed in the closed position, and in which the opening of the casing is disposed upward while the casing is disposed in the open position.

Clause 2. The imaging system according to clause 1, in which the pivotable connection includes a hinge and the hinge includes a pin and a bearing receiving the pin, and in which the pin is separable from the bearing and the lubricant unit is connected to the main body in an attachable and detachable manner.

Clause 3. The imaging system according to clause 2, in which the hinge defines a rotation center axis of the casing with respect to the main body, in which the main body includes a pair of bearings including the bearing and the bearings are arranged along the rotation center axis and are separated from each other in the extension direction of the rotation center axis, in which the casing includes a pair of pins including the pin, in which the pin includes a pin base provided in the casing and a pin tip portion insertable into the bearing, in which the pin tip portion protrudes from the pin base in a first direction along the rotation center axis, and in which the pin moves in a second direction opposite to the first direction from the bearing so that the lubricant unit is separated from the main body.

Clause 4. The imaging system according to clause 2 or 3, in which the main body includes a guide which extends between the pair of bearings and guides the pin in the first direction and the second direction.

Clause 5. The imaging system according to any one of clauses 1 to 4, in which the opening is relatively disposed downward while the casing is disposed in the closed position.

Clause 6. The imaging system according to any one of clauses 1 to 5, including:

a waste toner storage which is disposed below the pivotable connection and includes a concave portion recessed downward.

Clause 7. The imaging system according to any one of clauses 1 to 6, including:

a stopper which is provided in the main body and to contact the casing to define the position of the casing when the casing is located in the open position; and a contact portion which is provided in the casing and is able to contact the stopper.

Clause 8. The imaging system according to clause 7, in which the stopper is continuous in the extension direction of the rotation center axis of the casing.

Clause 9. The imaging system according to clause 2, including:

a main body side guide member that is disposed at an outside of the roller in the longitudinal direction of the roller and is connected to an apparatus body, in which the casing includes a convex portion which protrudes outwardly in the radial direction of the rotation center axis of the casing and is continuous in the extension direction of the rotation center axis, and in which the main body side guide member is provided with a concave portion through which the convex portion is able to pass in the extension direction of the rotation center axis.

Clause 10. The imaging system according to any one of clauses 1 to 9, in which the lubricant is provided with a drawing member that protrudes toward the opening while the lubricant is stored in the lubricant storage.

Clause 11. An imaging system including:

a photosensitive drum which includes an outer peripheral surface;

a lubricant roller which is disposed adjacent to the photosensitive drum to apply a lubricant to the outer peripheral surface of the photosensitive drum;

a main body which accommodates the photosensitive drum and the lubricant roller; and a lubricant unit which is disposed adjacent to the lubricant roller and includes a casing having an opening and a lubricant storage disposed inside the casing and storing the lubricant, in which the casing is connected to the main body through a hinge to be pivotable and detachable and is displaceable between a closed position and an open position, in which in the closed position, the lubricant storage is disposed at a position in which the lubricant is able to be supplied to the lubricant roller through the opening in a contact state, in which in the open position, the lubricant storage is disposed so that the opening is exposed to the outside of the main body, in which the hinge is disposed below the casing so that the opening of the casing is disposed downward while the casing is disposed in the closed position, and in which the opening of the casing is disposed upward while the casing is disposed in the open position.

Clause 12. The imaging system according to clause 11, in which the hinge defines a rotation center axis of the casing with respect to the main body, in which the main body includes a pair of bearings, and in which the bearings are disposed along the rotation center axis and are separated from each other in the extension direction of the rotation center axis.

Clause 13. The imaging system according to clause 12, in which the casing includes a pair of pins including a pin base, in which a tip portion of the pin is insertable into the bearing, in which the tip portion of the pin protrudes from the pin base in a first direction along the extension direction of the rotation center axis, and in which the pin is movable in a second direction opposite to the first direction to be separated from the bearing and the lubricant unit is separable from the main body.

Clause 14. An imaging system including:

a photosensitive drum which includes an outer peripheral surface;

a lubricant roller which is disposed adjacent to the photosensitive drum to apply a lubricant to the outer peripheral surface of the photosensitive drum;

a main body which accommodates the photosensitive drum; and a lubricant unit which is disposed adjacent to the lubricant roller and includes a casing having an opening and a lubricant storage disposed inside the casing and storing the lubricant, in which the casing is connected to the main body through a hinge to be pivotable and detachable and is displaceable between a closed position and an open position, in which the main body includes a first housing which accommodates the photosensitive drum and a second housing which accommodates the lubricant roller, and in which the second housing and the lubricant roller are pivotable with respect to the first housing along with the casing.

Clause 15. The imaging system according to clause 14, in which in the closed position, the lubricant storage is disposed at a position in which the lubricant is able to be supplied to the lubricant roller through the opening, in which in the open position, the lubricant storage is disposed so that the opening is exposed to the outside of the main body, in which in a state in which the casing is disposed in the closed position, the hinge is disposed below the casing and the opening of the casing is disposed downward, and in which in a state in which the casing is disposed in the open position, the opening of the casing is disposed upward.

The invention claimed is:

1. An imaging system comprising:

a main body to accommodate a roller; and a lubricant unit comprising a casing having an opening and a lubricant storage disposed inside the casing to store a lubricant, wherein the casing is pivotably connected to the main body via a pivotable connection to displace the casing between a closed position and an open position, wherein in the closed position, the lubricant storage is positioned to bring the lubricant in contact with the roller through the opening, wherein in the open position, the lubricant storage is disposed to expose the opening to an outside of the main body, wherein the pivotable connection is disposed below the casing when the casing is in the closed position, and wherein the opening of the casing is disposed upward when the casing is disposed in the open position.

2. The imaging system according to claim 1, wherein the pivotable connection comprises a hinge including a pin and a bearing to receive the pin, and wherein the pin is detachably coupled to the bearing to detach the lubricant unit from the main body.

3. The imaging system according to claim 2, wherein the hinge defines a rotational axis of the casing with respect to the main body, wherein the main body includes two bearings including the bearing, and the two bearings are arranged along the rotational axis and spaced apart from each other in an extension direction of the rotational axis, wherein the casing includes a pair of pins including the pin, wherein the pin includes a pin base provided in the casing and a pin tip to fit into the bearing, wherein the pin tip protrudes from the pin base in a first direction along the rotational axis, the pin being displaceable in a second direction opposite to the first direction from the bearing, to separate the lubricant unit from the main body.

4. The imaging system according to claim 3, wherein the main body includes a guide extending between the two bearings to guide the pin in the first direction and the second direction.

5. The imaging system according to claim 2, comprising:

a main body side guide disposed at an outside of the roller in a longitudinal direction of the roller, the main body side guide being connected to an apparatus body, wherein the casing includes a convex portion protruding outwardly in a radial direction of a rotational axis of the casing, the convex portion being continuous in an extension direction of the rotational axis, and wherein the main body side guide includes a concave portion through which the convex portion is displaceable in the extension direction of the rotational axis.

6. The imaging system according to claim 1, wherein the opening of the lubricant unit is disposed downward when the casing is disposed in the closed position.

7. The imaging system according to claim 1, comprising:

a waste toner storage disposed below the pivotable connection, the waste toner storage including a concave portion recessed downward.

8. The imaging system according to claim 1, wherein the main body comprises a stopper to limit a displacement of the casing when the casing is located in the open position, and wherein the casing comprises a contact portion to contact the stopper in the open position.

9. The imaging system according to claim 8, wherein the stopper is continuous in an extension direction of a rotational axis of the casing.

10. The imaging system according to claim 1, wherein the lubricant is provided with a drawing member that protrudes toward the opening when the lubricant is stored in the lubricant storage.

11. An imaging system comprising:

a photosensitive drum which includes an outer peripheral surface;

a lubricant roller disposed adjacent to the photosensitive drum to apply a lubricant to the outer peripheral surface of the photosensitive drum;

a main body accommodating the photosensitive drum and the lubricant roller; and a lubricant unit disposed adjacent to the lubricant roller, the lubricant unit including a casing having an opening and a lubricant storage disposed inside the casing to store the lubricant, wherein the casing is detachably connected to the main body via a hinge to be pivotably displaceable between a closed position and an open position, wherein in the closed position, the lubricant storage is disposed at a position to supply the lubricant to the lubricant roller through the opening in a contact state, wherein in the open position, the lubricant storage is disposed so that the opening is exposed to an outside of the main body, wherein the hinge is disposed below the casing so that the opening of the casing is disposed downward when the casing is disposed in the closed position, and wherein the opening of the casing is disposed upward when the casing is disposed in the open position.

12. The imaging system according to claim 11, wherein the hinge defines a rotational axis of a pivotal movement of the casing with respect to the main body, wherein the main body includes a pair of bearings disposed along the rotational axis and spaced apart in an extension direction of the rotational axis.

13. The imaging system according to claim 12, wherein the casing includes a pair of pins including a pin having a pin base and a tip portion insertable into one of the bearings, wherein the tip portion of the pin protrudes from the pin base in a first direction along the extension direction of the rotational axis, and wherein the pin is movable in a second direction opposite to the first direction to be separated from the bearing, in order to separate the lubricant unit from the main body.

14. An imaging system comprising:

a photosensitive drum having an outer peripheral surface;

a lubricant roller disposed adjacent to the photosensitive drum to apply a lubricant to the outer peripheral surface of the photosensitive drum;

a main body accommodating the photosensitive drum; and a lubricant unit disposed adjacent to the lubricant roller, the lubricant roller including a casing having an opening and a lubricant storage disposed inside the casing to store the lubricant, wherein the casing is connected to the main body through a hinge to be pivotable and detachable, and the casing is displaceable between a closed position and an open position, wherein the main body includes a first housing which accommodates the photosensitive drum and a second housing which accommodates the lubricant roller, and wherein the second housing and the lubricant roller are pivotable with respect to the first housing, together with the casing.

15. The imaging system according to claim 14, wherein in the closed position, the lubricant storage is disposed to supply the lubricant to the lubricant roller through the opening, wherein in the open position, the lubricant storage is disposed so that the opening is exposed to an outside of the main body, wherein in a state in which the casing is disposed in the closed position, the hinge is disposed below the casing and the opening of the casing is disposed downward, and wherein in a state in which the casing is disposed in the open position, the opening of the casing is disposed upward.

* * * * *